US007070382B2

(12) United States Patent
Pruteanu et al.

(10) Patent No.: US 7,070,382 B2
(45) Date of Patent: Jul. 4, 2006

(54) FULL EJECT MANUAL/AUTOMATED SIDE LOADER

(75) Inventors: Claudiu D. Pruteanu, Kasson, MN (US); John G. Pecka, Dodge Center, MN (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 252 days.

(21) Appl. No.: 10/414,659

(22) Filed: Apr. 16, 2003

(65) Prior Publication Data

US 2004/0208733 A1 Oct. 21, 2004

(51) Int. Cl.
*B65F 3/14* (2006.01)

(52) U.S. Cl. ..... 414/525.2

(58) Field of Classification Search ..... 414/406, 414/408, 409, 420, 421, 525.2, 517, 525.4
See application file for complete search history.

(56) References Cited

U.S. PATENT DOCUMENTS

| | | | | | |
|---|---|---|---|---|---|
| 2,487,411 | A | * | 11/1949 | Balbi | 414/492 |
| 3,232,463 | A | * | 2/1966 | Weir | 414/493 |
| 3,765,554 | A | * | 10/1973 | Morrison | 414/408 |
| 3,815,765 | A | | 6/1974 | Moser et al. | |
| 3,905,497 | A | * | 9/1975 | Stedman et al. | 414/408 |
| 3,921,839 | A | * | 11/1975 | Herpich | 414/408 |
| 4,096,956 | A | | 6/1978 | Gaskin | |
| 4,221,527 | A | | 9/1980 | Morrison | |
| 4,260,316 | A | | 4/1981 | Gollnick | |
| 4,316,695 | A | * | 2/1982 | Knight, Sr. | 414/517 |
| 4,892,454 | A | * | 1/1990 | Behling et al. | 414/406 |
| 5,651,654 | A | | 7/1997 | Christenson | |
| 5,769,592 | A | | 6/1998 | Christenson | |
| 5,857,822 | A | | 1/1999 | Christenson | |
| 5,931,628 | A | | 8/1999 | Christenson | |
| 6,332,745 | B1 | | 12/2001 | Duell et al. | |
| 6,435,802 | B1 | * | 8/2002 | Schreiber et al. | 414/517 |

FOREIGN PATENT DOCUMENTS

| | | |
|---|---|---|
| FR | 1502834 | 11/1967 |

* cited by examiner

*Primary Examiner*—Eileen D. Lillis
*Assistant Examiner*—Charles A. Fox
(74) *Attorney, Agent, or Firm*—Nikolai & Mersereau, PA; C. G. Mersereau

(57) ABSTRACT

A manual/automatic side loading and rear discharge refuse collection truck body as disclosed which incorporates full ejection without truck body tipping. A unique packing system as provided which includes a low profile packer panel which operates in a low profile charging material receiving hopper which also features lowered or dropped floor to facilitate optional manual loading. The charging hopper features a low profile which creates a dropper area beneath the forward portion of the storage enclosure so that material deposited in the charging hopper can be fed by the packing system into the storage enclosure through a bottom forward charging opening. A packer-ejector assist panel is provided to assist in clearing material from the dropped area portion of the charging hopper.

20 Claims, 8 Drawing Sheets

FULL EJECT MANUAL/AUTOMATED SIDE LOADER

BACKGROUND OF THE INVENTION

I. Field of the Invention

The present invention relates generally to refuse vehicles, particularly to dedicated side-loading, rear discharging refuse vehicle bodies capable of both manual and automated loading. More particularly, the invention relates to such vehicle bodies incorporating new compacting and ejecting mechanisms. The ejector provides full ejection of the packed contents of the body without the need for tipping the truck body as refuse is discharged. A charging hopper is provided having a floor and sidewalls lowered to facilitate manual loading in addition to optional automated loading using a mounted container handling mechanism. A low profile reciprocating packer panel moves refuse from the lowered or "dropped area" of the receiving hopper into a vehicle body storage enclosure through a bottom opening accessed from the hopper dropped area. A vertically pivoting packer-ejector assist panel is provided to clear the dropped area during ejection and optionally assist packing if desired.

II. Related Art

Refuse hauling trucks commonly include a heavy-duty chassis and a hollow truck body mounted on the chassis dedicated to receiving, compacting, discharging refuse materials. This combination generally includes all the associated hydraulic, pneumatic and/or electrical operating mechanisms associated with heavy-duty packing and ejection equipment. In side loading system, the truck cab is located in front of the receiving hopper which charges a rear storage enclosure. Refuse to be hauled is loaded into the receiving hopper as by dumping containers either manually or using a mechanized container handling device mounted on the charging hopper or truck chassis. A packing device including a reciprocating or rotating ram, usually hydraulically operated, compacts the material moving it rearward into the storage compartment. Loading of the charging hopper is accomplished through side openings. The bottom or floor of the charging hopper typically is located at a height equal to or above that of the storage enclosure.

It is known to provide a front or side loading refuse vehicle with a packing and ejecting mechanism that packs refuse from a charging hopper into an associated hollow storage enclosure and later fully ejects the refuse from the storage enclosure. An example of such a refuse truck body system is shown in U.S. Pat. No. 5,857,822. It is also known to provide a side loading refuse vehicle having a recessed or dropped receiving hopper floor and chassis relative to a storage body floor to enable material receiving opening to start corresponding closer to the ground to facilitate the manual loading of the receiving hopper. An example of this type truck body is illustrated and described in U.S. Pat. No. 5,931,628.

It is also known to provide a mechanized lifting and emptying apparatus situated on one side of the receiving hopper such that a container of interest may be engaged on that side and emptying through the material receiving opening into the receiving hopper. Such an apparatus typically includes a holding or grasping device generally connected to an arm or extensible boom which is connected, in turn, to a base mounted on the vehicle. The arm or boom and grasping device are operated in concert to engage the container of interest, lift and dump the container into the receiving hopper in the vehicle. Such systems are typically operated using one or more hydraulic devices to extend or retract the boom, pivot the arm and open and close the grabbing device. Examples of such booms are shown in U.S. Pat. Nos. 5,657,654, 5,769,592 and 5,931,628 (mentioned above).

While the prior devices of the related art have met with a certain amount of success, there remains a definite need for a mechanically simplified, lower maintenance full eject side loading refuse collection truck body that offers both manual and automated loading in which the packer is constructed in a manner which cannot interfere with the loading of refuse and which includes a full ejection mechanism which allows full emptying of the storage chamber of the truck body without the need for tipping.

SUMMARY OF THE INVENTION

By means of the present invention, there is provided a side loading refuse collection vehicle body for loading, compacting, transporting and ejecting refuse materials. The truck body includes a hollow refuse storage enclosure for containing collected and compacted refuse that has a rear refuse discharge opening including a tailgate against which the refuse is packed in a forward bottom refuse receiving opening which connects with a charging hopper disposed forward of the storage enclosure for receiving refuse from refuse containers which are tipped manually. A mechanized container handling device may be optionally mounted on the charging hopper as depicted in the detailed embodiment. The portion of the truck body including the charging hopper and the area beneath the storage enclosure refuse receiving opening is lowered so that manual loading is facilitated.

Deposited refuse is pushed back and up into the storage compartment by a low profile and reciprocating packing ram mechanism. The reciprocating packing ram mechanism itself also includes a follower so that it is not possible to deposit refuse behind the packer even if the ram is in the full forward position.

The packing and ejection mechanisms include a packer-ejector assist panel or blade which pivots in a vertical plane to sweep refuse materials deposited in and pushed to the rear of the charging hopper in the dropped area by the packer panel from the charging hopper into the storage enclosure. This device is attached to the ejector panel and is designed to be operated in conjunction with the full-eject ejection mechanism to clear the dropped area, but, as indicated, may also be operated to assist in the packing operation. In a preferred embodiment, the packer-ejector assist panel is mounted on spaced in-line shafts journaled in fixed mounts on the full-eject ejector panel structure and which are driven from a centrally located, double-ended hydraulic motor which rotates the spaced aligned shafts and pivots the blade through an arc subtending an angle of about 270°. The packer-ejector assist panel extends laterally across the width of the charging hopper.

The system also includes a full-eject ejector mechanism that operates in the storage enclosure and which includes a transverse, generally vertical ejection panel operable along a path whose direction is parallel to the length of the refuse storage enclosure to provide complete ejection of the contents without the need for tipping the storage body during the ejection operation. The ejection mechanism is operated by a single telescoping linear operator, preferably a telescoping double-acting hydraulic cylinder connected behind the panel for reciprocally operating the panel during an ejection cycle.

When it is not in use, the vertically pivoting packer-ejector assist blade is pivoted up to a generally vertical posture and so it is completely out of the way of refuse being deposited and packed by the reciprocating mechanism.

The container manipulating and emptying system which can be mounted on the charging hopper preferably includes an offset, short radius lift and dump arm mechanism having a narrow profile with a grabber offset mounted from a laterally extendable boom device which gives the system the desired lateral range in accessing containers of interest. The offset and arm construction further reduce the tipping radius and tipping height to facilitate addressing the low profile hopper opening of a manual/automated side loading refuse vehicle and the system, when not in use, presents a narrow profile which does not extend or protrude laterally beyond the width of the rest of the vehicle.

BRIEF DESCRIPTION OF THE DRAWINGS

In the drawings wherein like numerals depict like parts throughout the same.

DETAILED DESCRIPTION

The present invention incorporates full ejection without truck body tipping, together with optional manual/automatic side loading and rear discharge in a refuse collection truck body. A unique packing system is provided which includes a low profile packer panel which operates in a low profile charging or material receiving hopper which also features a lowered or dropped floor to facilitate optional manual loading. An associated hollow storage chamber enclosure is located behind the charging hopper which, in combination with the low profile, dropped floor charging hopper creates a dropped area beneath the forward portion of the storage enclosure so that material deposited in the charging hopper can be fed by the packing system into the storage enclosure through a bottom forward charging opening and thereafter be pushed and packed against a heavy rear tailgate discharge door.

A packer-ejector assist panel is provided to assist in clearing material from the dropped portion of the charging hopper located beneath the storage chamber or dropped area. The packer-ejector assist panel is in the form of a vertically pivoting blade which moves with a generally vertical ejector blade which travels the entire length of the storage enclosure during the ejection operation.

The embodiment illustrated and described in the specification is intended by way of example only and is not intended to limit the scope of the invention concepts in any way. The features of the invention may be manifested in a variety of forms within the confines of the scope of the contemplated invention.

Figure 1:
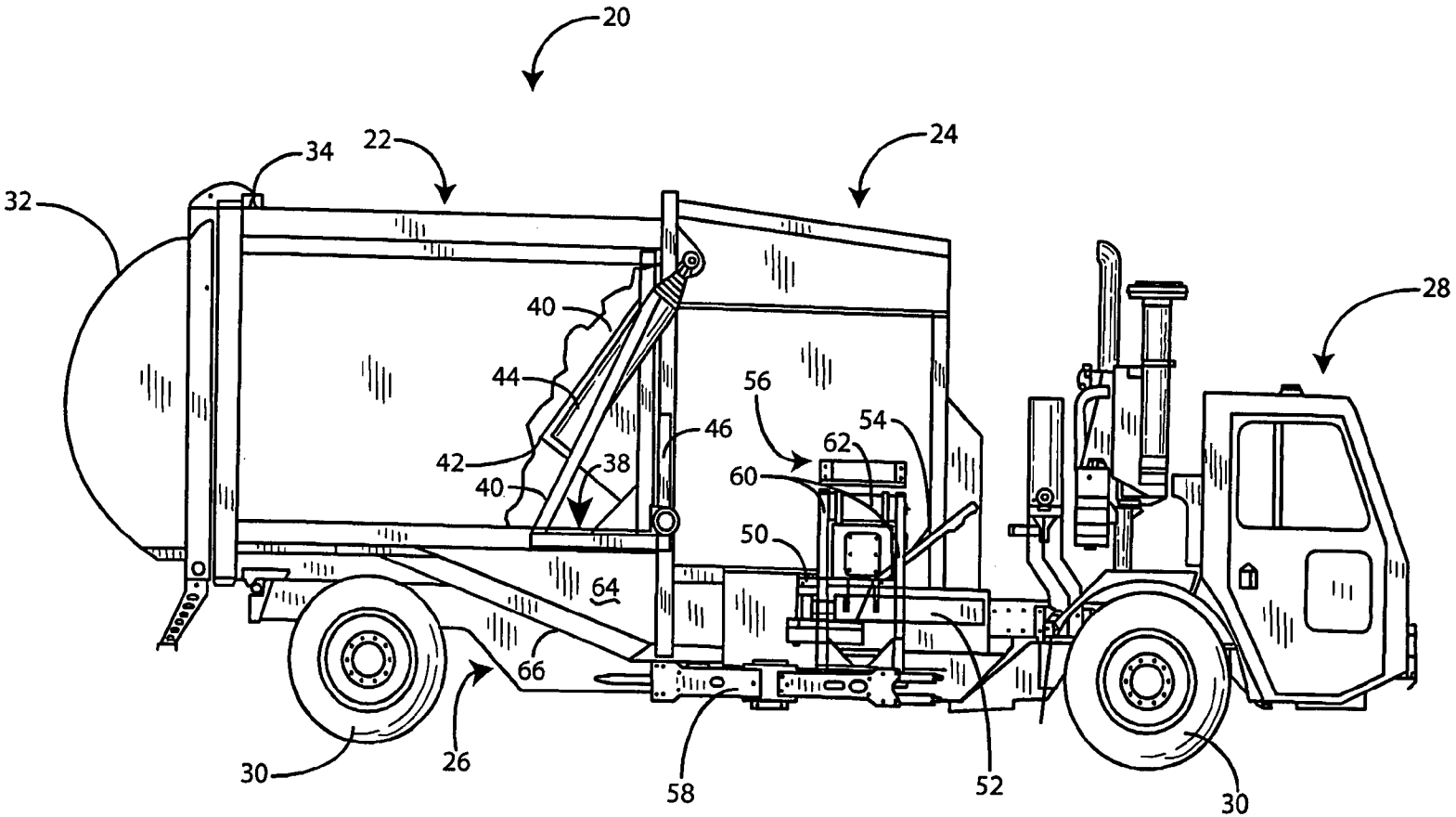
FIG. 1 is a side elevational view of a side loading refuse collection vehicle with internal parts exposed incorporating one preferred embodiment of the present invention depicted at the beginning (or end) of a packing cycle with the rotating packer-ejector assist panel and the packer panel in fully retracted positions.
Figure 2:
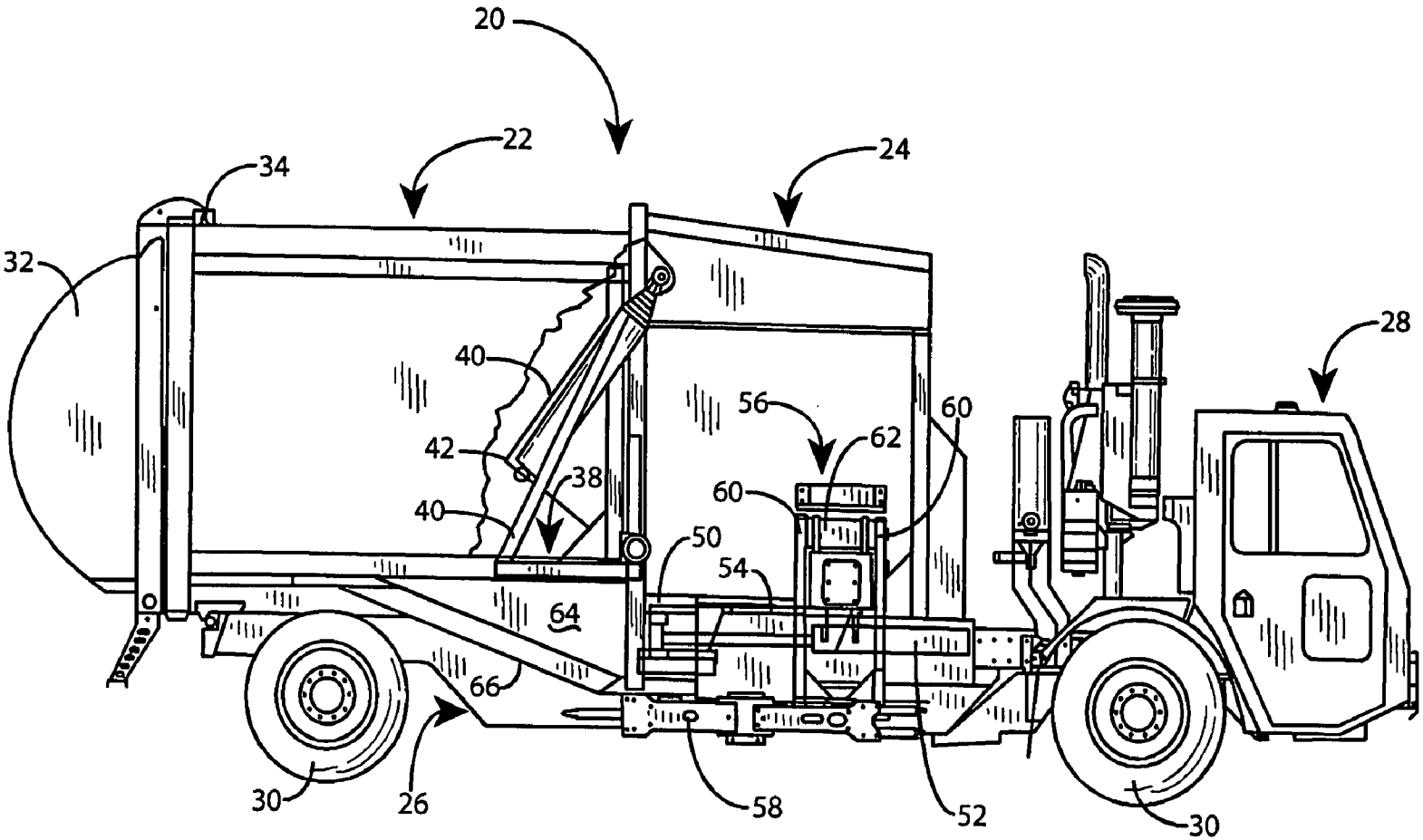
FIG. 2 is a view similar to FIG. 1 showing the packer panel in the advanced or packing position.

Given the above, FIGS. 1 and 2 depict a side loading refuse truck illustrating successive stages of refuse collecting or loading and FIGS. 3–6 depict such a vehicle in several stages of an ejection cycle. The refuse truck, generally at 20, includes a large hollow refuse storage enclosure 22 connected to or integral with a receiving or charging hopper 24, both of which are mounted on a heavy duty truck chassis 26 which also carries a conventional cab 28 and is mounted on wheels 30 in a conventional manner. The storage enclosure 22 is provided with a full size rear discharge opening closed by a heavy tailgate 32 which pivots vertically from a pair of top hinges, one of which is shown at 34. The tailgate is typically opened by a pair of hydraulic cylinders, one of which is shown at 36. The tailgate 32 is in the shape of a heavy duty pressure vessel member and refuse compacted into the storage enclosure 22 is pushed up against the tailgate when compacted so that it must withstand full compaction pressure. The refuse storage enclosure further includes a forward bottom refuse receiving opening 38 which extends across the full width of the storage enclosure in a full width, generally vertical, ejector panel 40 which has a protruding nose as at 42 which is adapted to receive the cylinder and of a large telescoping, double-acting hydraulic cylinder 44 which operates the packer panel 40 fore and aft along in the enclosure 22.

Attached to the rear portion of the ejector panel 40 is a pivotally mounted packer-ejector assist panel 46 which, together with the details of the mounting of the telescoping cylinder 44, are depicted in the front storage enclosure elevational view of FIG. 7, as will be discussed.

The charging hopper also includes a packer ram or packer panel 50 operated by a pair of double-acting hydraulic cylinders, one of which is shown at 52, and which includes a follower system depicted at 54 to prevent material from being deposited behind the packer 50. An optional automated loader arm or container emptying system is shown generally at 56 mounted on the forward portion of the charging hopper which includes an offset grabber system at 58 and includes an extensible boom (not shown) to give the system an extended lateral reach. Container emptying system 56 features the grabber assembly 58 mounted from the free ends of spaced parallel arm members 60, the fixed ends being connected to the opposite output ends of a double-ended hydraulic rotary actuator 62 which directly carries the arm assembly and reversibly rotates the assembly in a vertical plane at actuator 62 in the illustrated embodiment. One possible embodiment of such a system is illustrated and described in greater detail in co-pending application Ser. No. 09/844,843, entitled "AUTOMATED LOADER ARM", assigned to the same assignee as the present invention, the entire contents of which is hereby incorporated by reference for any purpose.

Figure 8:
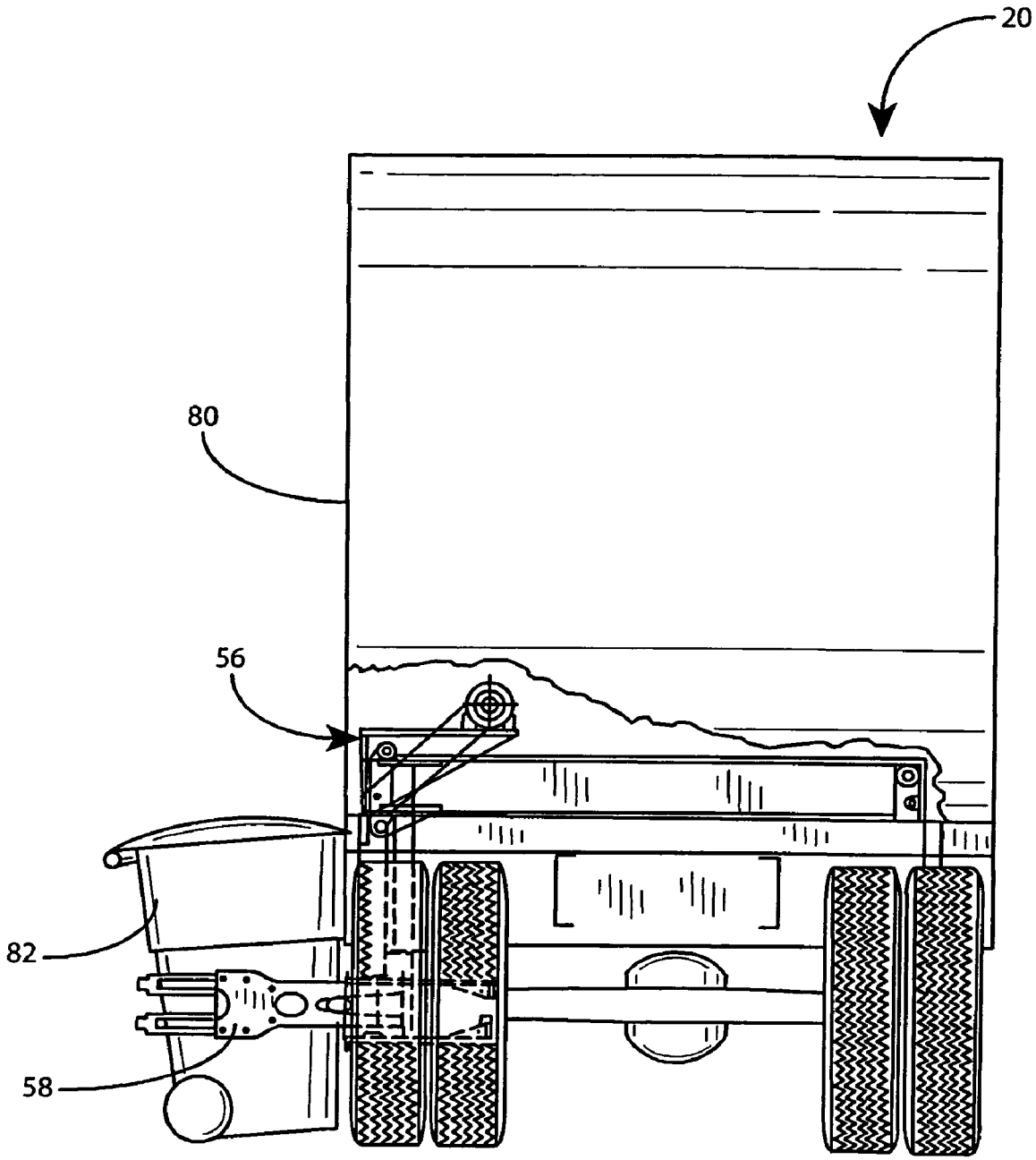
FIG. 8 is a rear view of the refuse vehicle of FIG. 1 showing the profile of the container lift and dump mechanism in a retracted position.

The chassis 26 is built in a lowered configuration to accommodate the lowered charging hopper and drop area 64 beneath the opening 38 in the storage enclosure 22 as evidenced by chassis structural member 66. Note that the side rim 68 in the charging hopper 24 is at or below the level of the floor 70 of the storage enclosure 22 to enable easy manual loading over the grabber device 58 when it is retracted. As can be seen in the rear elevational view of the vehicle in FIG. 8, the container emptying system 56 has a narrow profile such that when it is in the retracted position, it does not protrude beyond the edge of the vehicle as designated by reference line 80 in FIG. 8. A grabbed container is shown at 82, however, the grabber, when retracted, is within line 80.

Figure 7:
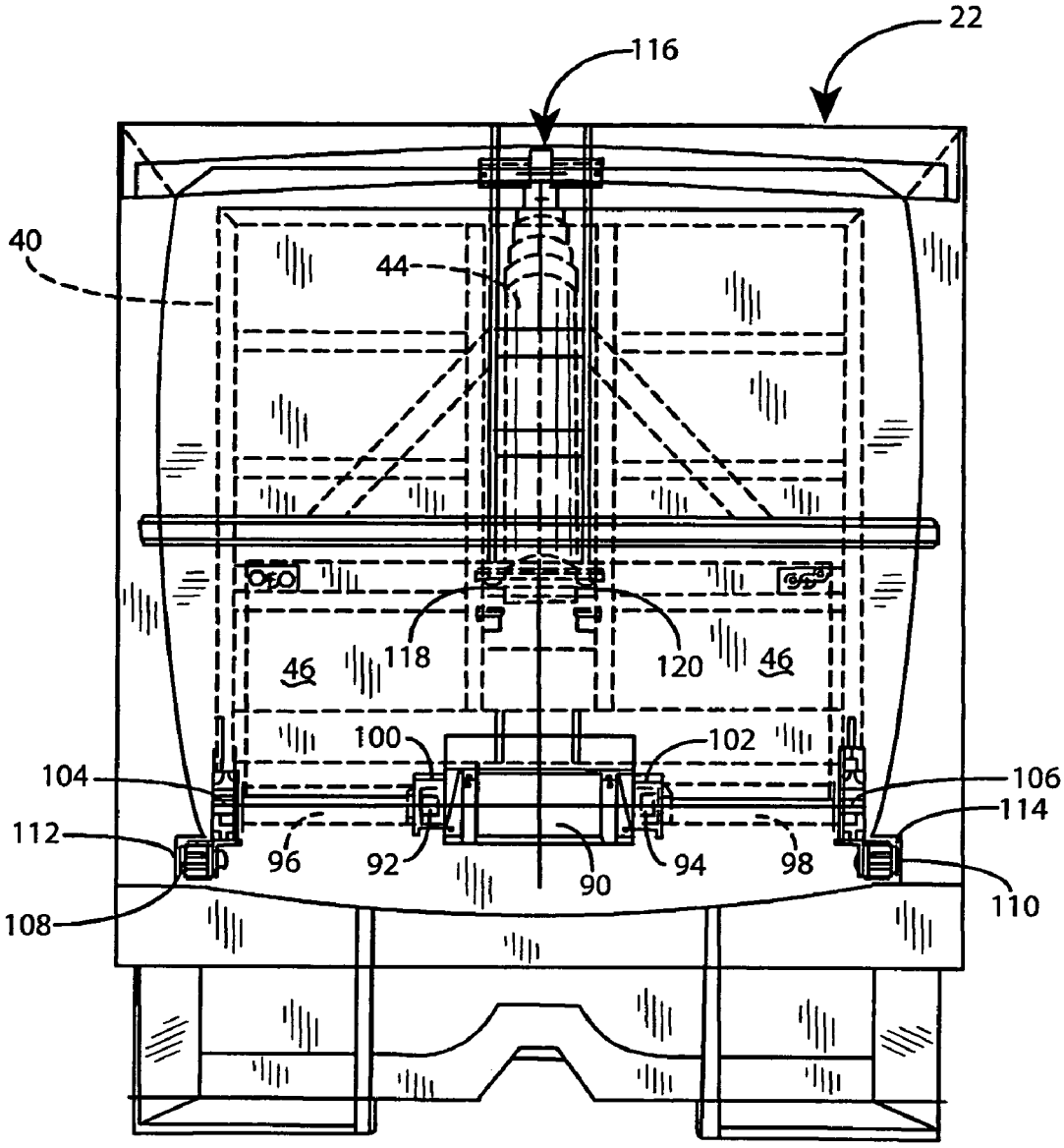
FIG. 7 is a front elevational view from the charging hopper of a refuse storage enclosure as in FIGS. 1–6 showing the mounting of the packer-ejector assist panel and linear ejector blade operator.

FIG. 7 shows more detail with respect to the packer-ejector assist panel 46 including a hydraulic rotary motor 90 having dual output shafts 92 and 94, respectively, connected to spaced aligned panel carrying shafts 96 and 98 as by connections 100 and 102. Shafts 96 and 98 are respectfully journaled in bearing mounts 104 and 106. The ejector panel 40 is further supported by one or more pairs of spaced wear shoes as at 108 and 110 which ride in corresponding rails at 112 and 114 as the packer panel reciprocates along the length of storage enclosure 22. The telescoping cylinder 44 is further pivot mounted including a top pivot mount 116 and lower pivot mounts 118 and 120 as further shown in the detail of FIG. 7.

Beginning with the view of FIG. 1, the operating sequence of the system will be described. FIG. 1 shows the side loading refuse vehicle of the invention with both the packer ram 50 and the packer-ejector assist blade 46 in their fully retracted or stowed positions with the tailgate 32 closed and the ejector panel 40 in the fully retracted position ready to receive material into the charging hopper 24, either by using the container handling system 56 or manually. In FIG. 2, material has been added to the charging hopper 24 and the packing ram 50 is shown in the fully forward packing position as used to urge refuse out of the charging hopper 24 into the drop area 64 from which it is forced up into the storage enclosure 22. This continues until the storage enclosure chamber 22 is entirely full with refuse being packed up against the tailgate 32 at which time it is necessary to eject the garbage from the storage area, normally at a landfill.

Figure 3:
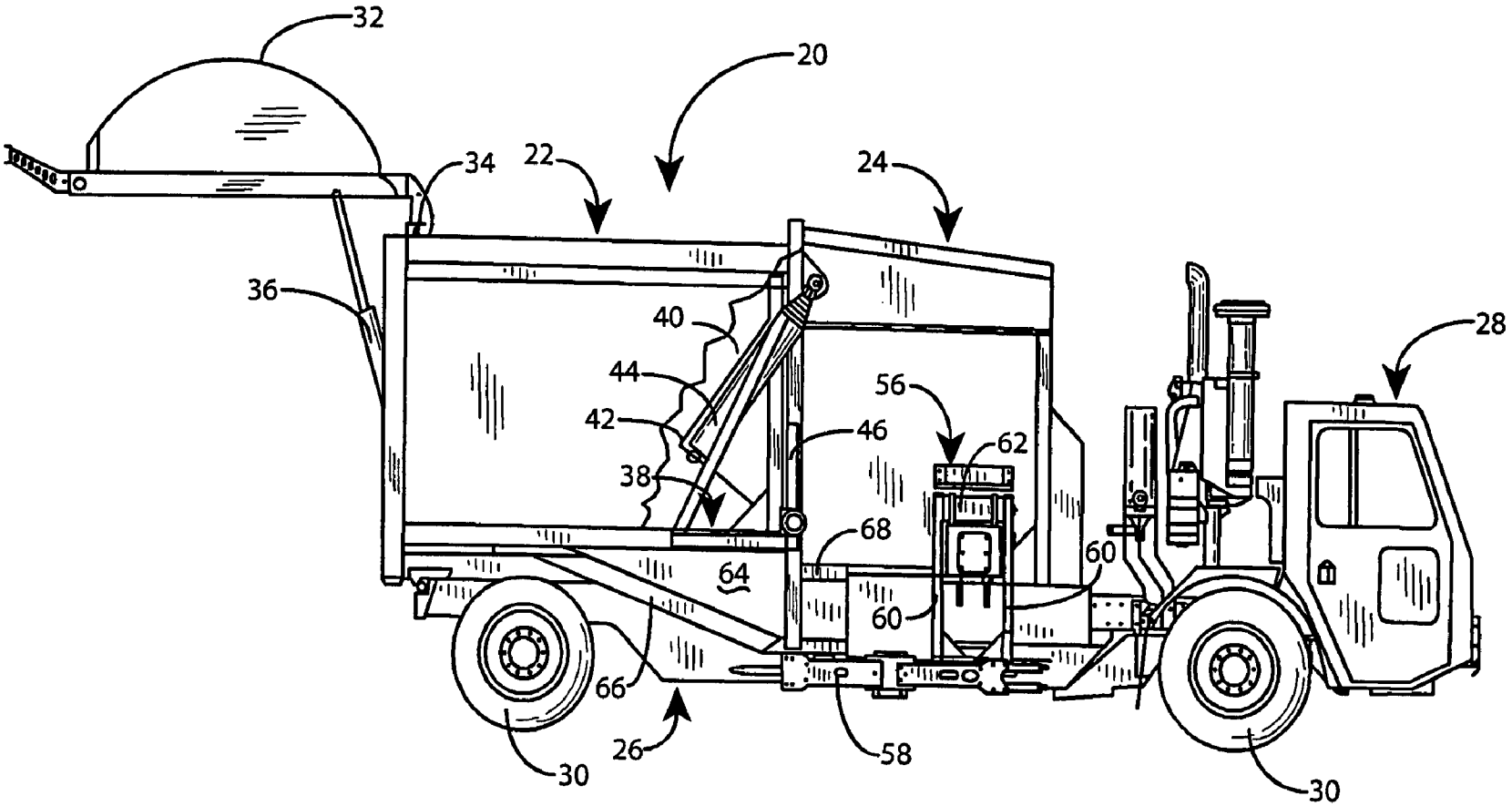
FIG. 3 is a view similar to FIGS. 1 and 2 showing the system at the beginning of an ejection cycle with the tailgate raised and the packer mechanism removed for clarity.
Figure 4:
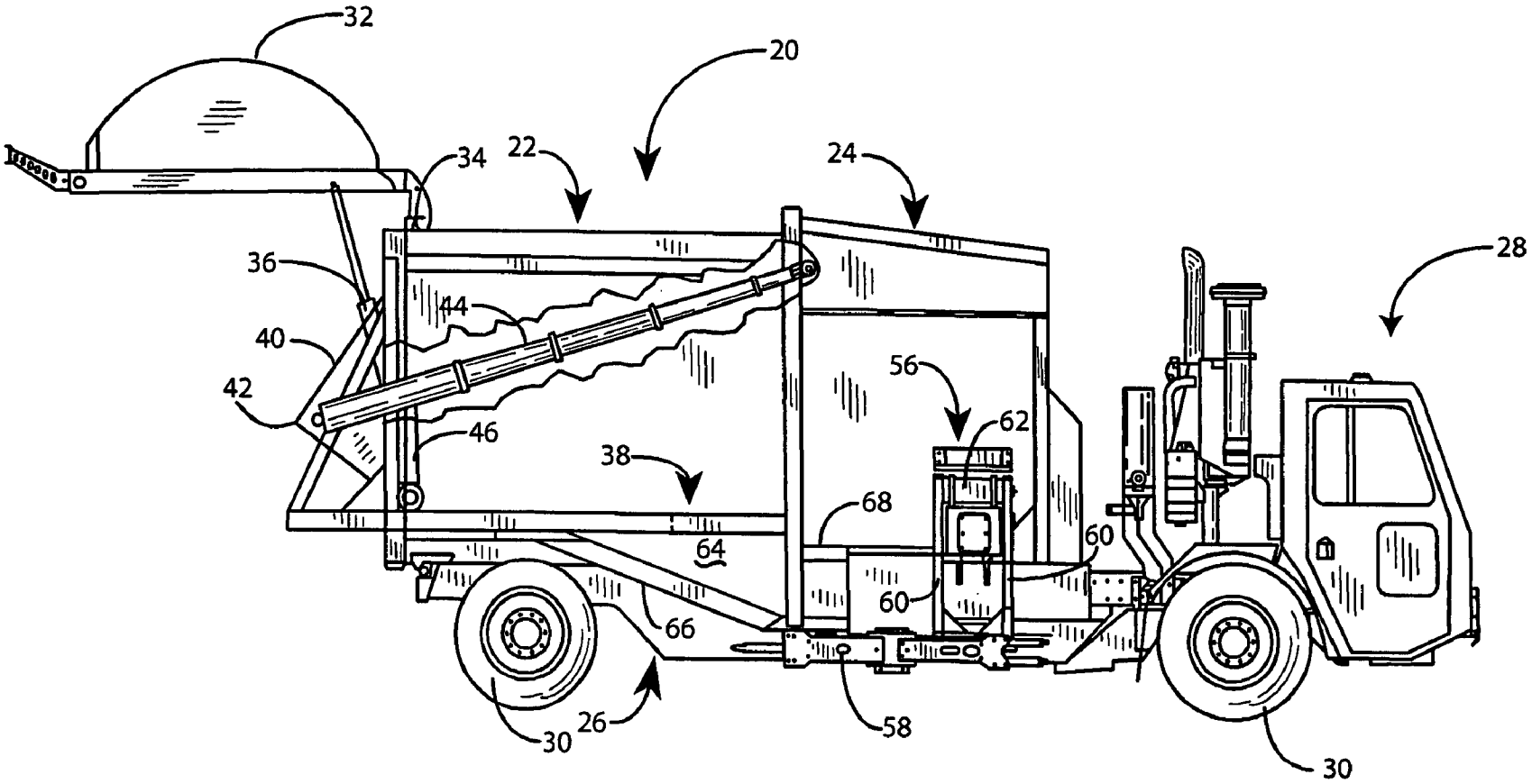
FIG. 4 is a view similar to FIG. 3 showing the system at full eject in an initial load pushout.
Figure 5:
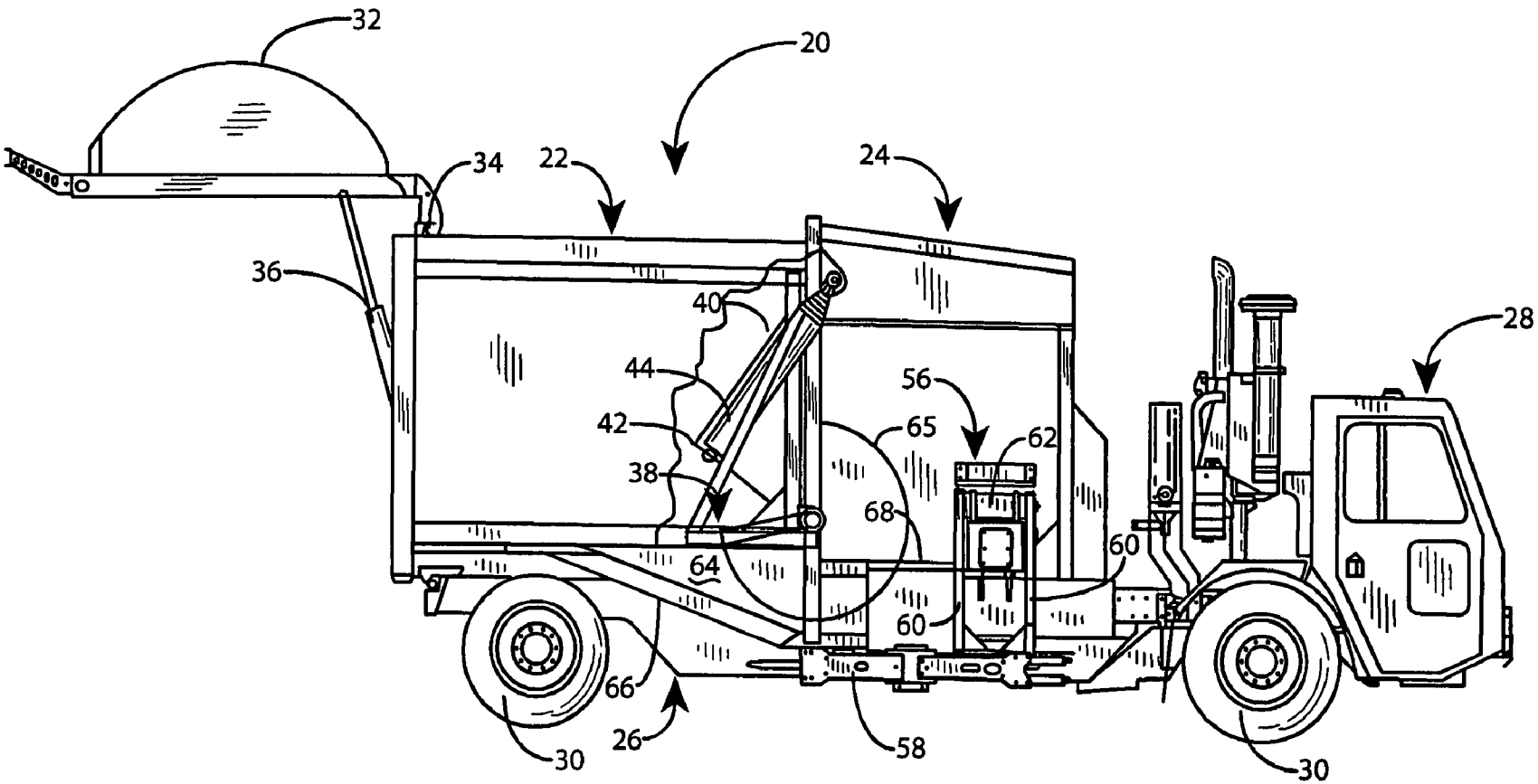
FIG. 5 is a view similar to FIG. 3 with the ejector fully retracted and the packer-ejector assist panel fully rotated to sweep clean the drop area.
Figure 6:
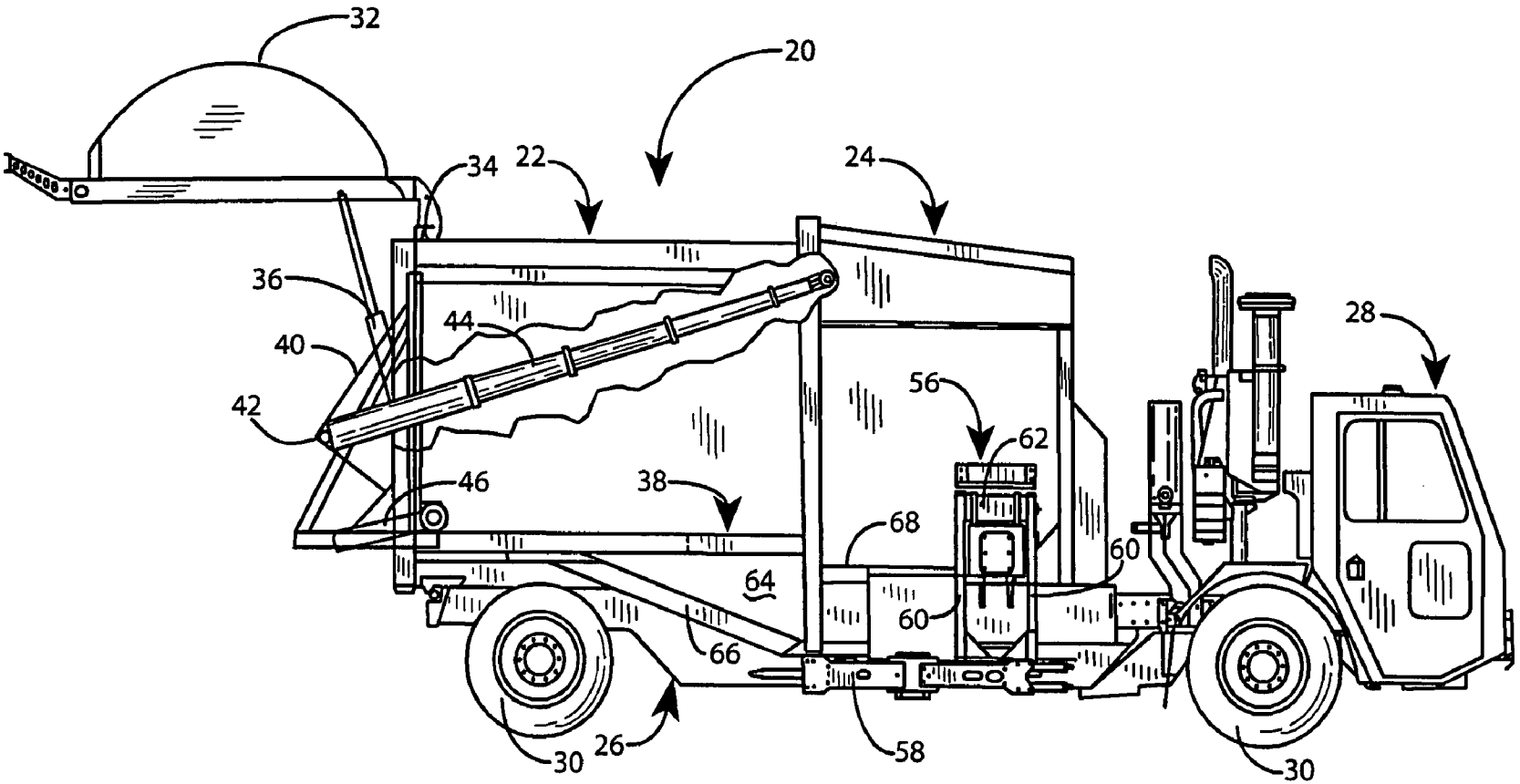
FIG. 6 is a view similar to FIG. 4 showing the system in a second full-eject power stroke position of the ejection cycle with the packer-ejector assist panel fully rotated to eject material from the drop area.

Steps in the ejection cycle are shown in FIGS. 3–6. In FIG. 3, the system is shown with both the packing ram and the packer-ejector assist panel 46 in the fully retracted positions as is the ejector panel 40, the tailgate 32 having been unlatched and raised in preparation for ejection. In FIG. 4, the ejector panel 40 is shown in the complete rearward or full eject position having pushed all the materials within the confines of the storage enclosure 22 out of that chamber. This completely ejects the material collected by the vehicle except for a minor amount of material remaining in the drop area 64. FIG. 5 depicts the ejection panel 40 after it has been fully retracted following the initial full ejection stroke and the packer-ejector assist panel has been fully rotated describing an arc shown at 65 to push the material remaining in the drop area 64 ahead of it as it is rotated to provide substantial closure of the storage enclosure charging opening 38. Finally, as shown in FIG. 6, the second full-eject stroke is performed with the packer-ejector assist panel remaining in the fully rotated position so that material scooped from the drop area is also ejected. It should be noted that the step of pivoting the packer-ejector panel can be carried out during the packing operation between strokes of the packer ram, if desired, to assist in the packing operation.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A side loading, refuse collection vehicle body for loading, compacting, transporting and ejecting refuse materials comprising:

(a) a hollow refuse storage enclosure for containing compacted refuse having a rear refuse discharge opening including a tailgate and a forward bottom refuse receiving opening extending across said storage enclosure;

(b) a charging hopper disposed forward of said storage enclosure and having a width generally equal to the width of said storage enclosure for receiving refuse from refuse containers, said charging hopper having a floor lower than that of said storage enclosure thereby creating a dropped receiving volume, said dropped receiving volume being in communication with said refuse receiving opening of said storage enclosure;

(c) a generally linearly operating packing mechanism extending across said charging hopper for moving refuse materials deposited in said charging hopper from said charging hopper into said storage enclosure and packing said refuse materials in said storage enclosure;

(d) a reciprocating ejection mechanism in said storage enclosure, said ejection mechanism further comprising a transverse, generally vertical ejection panel operable along a direction parallel to the length of said refuse storage enclosure a sufficient distance to provide complete ejection of the contents thereof, a linear operator for selectively reciprocally operating said ejection panel during an ejection stroke; and (e) a packing-ejection assist panel comprising a transverse vertically pivoting blade generally extending across said refuse receiving opening situated to selectively sweep material in said dropped area generally rearward and selectively block a major portion of said forward bottom refuse receiving opening during selected ejection strokes of said ejection panel.

2. A refuse collection vehicle body as in claim 1 further comprising a container handling mechanism associated with said charging hopper for emptying refuse containers into said charging hopper.

3. A refuse collection vehicle body as in claim 2 wherein said container handling mechanism is mounted on a side of said charging hopper.

4. A refuse collection vehicle body as in claim 3 wherein said container handling mechanism is mounted in an offset arrangement to accommodate manual loading alongside.

5. A refuse collection vehicle body as in claim 1 wherein said linear operator is a telescoping hydraulic cylinder.

6. A refuse collection vehicle body as in claim 1 wherein said transverse vertically pivoting blade is operated by a hydraulic motor rotating at least one mounting shaft.

7. A refuse collection vehicle body as in claim 1 wherein said transverse pivoting blade is mounted on a pair of aligned mounting shafts operated by a central dual-shaft hydraulic motor.

8. A refuse collection vehicle body as in claim 1 wherein said generally linearly operating packing mechanism is a generally low profile reciprocating packing ram mechanism and includes an attached follower device to prevent material from being deposited behind the packing mechanism.

9. A side-loading refuse collection vehicle body for loading, compacting, transporting and ejecting refuse materials comprising:

(a) a hollow refuse storage enclosure for containing compacted refuse having a rear refuse discharge opening including a tailgate and a forward bottom refuse receiving opening;

(b) a charging hopper disposed forward of said storage enclosure for receiving refuse and having a floor lower than that of said storage enclosure thereby creating a dropped receiving volume, said dropped receiving volume being in communication with said refuse receiving opening of said storage enclosure;

(c) a packing mechanism in said charging hopper for moving refuse materials deposited in said charging hopper into said storage enclosure and packing said refuse materials in said storage enclosure;

(d) a reciprocating ejection mechanism in said storage enclosure, said ejection mechanism further comprising a transverse, generally vertical ejection panel operable along a direction parallel to the length of said refuse storage enclosure a sufficient distance to provide complete ejection of the contents thereof, a linear operator for selectively reciprocally operating said ejection panel during an ejection stroke; and (e) a packing-ejection assist panel attached to travel with said ejection panel and comprising a transverse vertically pivoting blade for selectively sweeping said dropped area and selectively blocking a major portion of said forward bottom refuse receiving opening during selected ejection strokes of said ejection panel.

10. A refuse collection vehicle body as in claim 9 wherein said transverse vertically pivoting blade is operated by a hydraulic motor rotating at least one mounting shaft.

11. A refuse collection vehicle body as in claim 9 herein said transverse pivoting blade is mounted on a pair of aligned mounting shafts operated by a central dual-shaft hydraulic motor.

12. A refuse collection vehicle body as in claim 9 wherein said generally linearly operating packing mechanism is a generally low profile reciprocating packing ram mechanism and includes an attached follower device to prevent material from being deposited behind the packing mechanism.

13. A refuse collection vehicle body as in claim 9 wherein said transverse vertically pivoting blade of said packing-ejection assist panel stows in a substantial vertical posture against said ejection mechanism structure.

14. A refuse collection vehicle body as in claim 13 wherein said vertically pivoting blade of said packer-ejector assist panel pivots through an arc subtending an angle of about 270°.

15. A refuse collection vehicle body as in claim 14 wherein said transverse pivoting blade is mounted on a pair of aligned mounting shafts operated by a central dual-shaft hydraulic motor.

16. A refuse collection vehicle as in claim 15 further comprising a container handling mechanism mounted on said charging hopper for emptying refuse containers into said charging hopper.

17. A side loading, refuse collection vehicle body for loading, compacting, transporting and ejecting refuse materials comprising:

(a) a hollow refuse storage enclosure for containing compacted refuse having a rear refuse discharge opening including a tailgate and a forward bottom refuse receiving opening;

(b) a charging hopper disposed forward of said storage enclosure for receiving refuse and having a floor lower than that of said storage enclosure thereby creating a dropped receiving volume, said dropped receiving volume being in communication with said refuse receiving opening of said storage enclosure;

(c) a packing mechanism in said charging hopper for moving refuse materials deposited in said charging hopper into said storage enclosure and packing said refuse materials in said storage enclosure;

(d) a reciprocating ejection mechanism in said storage enclosure, said ejection mechanism further comprising a transverse, generally vertical ejection panel operable along a direction parallel to the length of said refuse storage enclosure a sufficient distance to provide complete ejection of the contents thereof, a linear operator for selectively reciprocally operating said ejection panel during an ejection stroke; and (e) a packing-ejection assist panel comprising a transverse vertically pivoting blade for selectively sweeping said dropped area and selectively blocking a major portion of said forward bottom refuse receiving opening during selected ejection strokes of said ejection panel, wherein said transverse vertically pivoting blade of said packing-ejection assist panel stows in a substantial vertical posture against said ejection mechanism structure.

18. A refuse collection vehicle body as in claim 17 wherein said vertically pivoting blade of said packer-ejector assist panel pivots through an arc subtending an angle of about 270°.

19. A refuse collection vehicle comprising:

(a) a vehicle chassis;

(b) a refuse collection vehicle body for loading, compacting, transporting and ejecting refuse materials mounted on said chassis and further comprising:

1) a hollow refuse storage enclosure for containing compacted refuse having a rear refuse discharge opening including a tailgate and a forward bottom refuse receiving opening;

(2) a charging hopper disposed forward of said storage enclosure for receiving refuse and having a floor lower than that of said storage enclosure thereby creating a dropped receiving volume, said dropped receiving volume being in communication with said refuse receiving opening of said storage enclosure;

(3) a generally linearly operating packing mechanism associated with said charging hopper for moving refuse materials deposited in said charging hopper into said storage enclosure and packing said refuse materials in said storage enclosure;

(4) a reciprocating ejection mechanism in said storage enclosure, said ejection mechanism further comprising a transverse, generally vertical ejection panel operable along a direction parallel to the length of said refuse storage enclosure a sufficient distance to provide complete ejection of the contents thereof, a linear operator for selectively reciprocally operating said ejection panel during an ejection stroke; and (5) a packing-ejection assist panel attached to travel with said ejection panel comprising a transverse vertically pivoting blade situated to selectively sweep material in said dropped area generally rearward and selectively block a major portion of said forward bottom refuse receiving opening during selected ejection strokes of said ejection panel.

20. A refuse collection vehicle as in claim 19 further comprising a container handling mechanism mounted on said charging hopper for emptying refuse containers into said charging hopper.

* * * * *